US005133320A

United States Patent [19]

Kato et al.

[11] Patent Number: 5,133,320

[45] Date of Patent: Jul. 28, 1992

[54] SAFETY APPARATUS FOR COMBUSTION ENGINE

[75] Inventors: Hideki Kato, Toyohashi; Minoru Kuroda, Nagoya; Masaki Akutagawa; Kunio Nanba, both of Kariya, all of Japan

[73] Assignee: Nippondenso Co., Ltd., Kariya, Japan

[21] Appl. No.: 735,015

[22] Filed: Jul. 25, 1991

[30] Foreign Application Priority Data

Jul. 27, 1990 [JP] Japan ..... 2-200825

[51] Int. Cl.[5] ..... F02D 7/00

[52] U.S. Cl. ..... 123/397; 123/337

[58] Field of Search ..... 123/337, 397; 261/63, 261/65

[56] References Cited

U.S. PATENT DOCUMENTS 3,880,125 4/1975 Kammerer et al. .
4,433,655 2/1984 Villella .
4,779,590 10/1988 Utgoff, Jr. ..... 123/337

FOREIGN PATENT DOCUMENTS 59-46346 3/1984 Japan .
60-43163 3/1985 Japan .
61-40621 3/1986 Japan .
62-66240 4/1987 Japan .
62-56446 11/1987 Japan .
2-252927 10/1990 Japan .

*Primary Examiner*—Raymond A. Nelli
*Attorney, Agent, or Firm*—Cushman, Darby & Cushman

[57] ABSTRACT

A safety apparatus for a combustion engine includes a rotary member disposed in a rotating portion of the internal combustion engine, a spiral spring supported by the rotary member at one end and biasing the rotary member in a predetermined direction, an engaging member engaging with the other end of the spiral spring, a housing for receiving the spiral spring, and a guide member arranged over at least the outer side periphery of the overlapping portion of the spiral spring and extending along the circumferential direction of the spiral spring to prevent the spiral spring from expanding in diameter. With this construction, when breakage is caused in the spiral spring, hooking of the broken end onto the engaging member can be prevented by the guide member. Therefore, it can prevent the throttle valve from being biased toward opening direction by the broken spiral spring.

6 Claims, 3 Drawing Sheets

SAFETY APPARATUS FOR COMBUSTION ENGINE

BACKGROUND OF THE INVENTION

The present invention relates to a safety apparatus for rotary components of an internal combustion engine, and more particularly to a throttle valve opening and closing device for controlling intake air flow rate.

Conventionally, there are throttle valve opening and closing device, in which a torsion coil spring is wound around a rotary shaft of a throttle valve. However, since the torsion coil spring requires certain length in the axial direction, the length of the rotary shaft has to be lengthened for the corresponding length to make the overall size of the device bulky. For this reason, there has been proposed a throttle valve opening and closing device which employs a spiral spring in place of the torsion coil spring (for example, Japanese Patent Application Laid Open No. 46346-1984.

However, in the throttle valve opening and closing device employing the spiral spring as set forth above, when breakage of the spiral spring occurs, the broken end can expand in diameter to hook on a hooking pin and so forth to bias the throttle valve in opening direction.

According to the present invention, it is an object to provide a throttle valve opening and closing device for an internal combustion engine which can provide enhanced safety, in which the throttle valve will never biased in the opening direction even when breakage of the spiral spring is caused.

SUMMARY OF THE INVENTION

A principle of a safety apparatus for a combustion engine, according to the present invention, includes a rotary member disposed in a rotating portion of the internal combustion engine, a spiral spring supported by the rotary member at one end and biasing the rotary member in a predetermined direction, an engaging member engaging with the other end of the spiral spring, a housing for receiving the spiral spring, and a guide member arranged at least over the overlapping portion of outer circumferential side of the spiral spring and adapted to prevent the spiral spring from expanding in diameter.

By this, the rotary member is biased in a predetermined direction by means of the spiral spring, one end of which is supported by the rotary member and the other end is supported by the engaging member. In addition, by means of the guide member arranged at least over the outer circumferential side of the overlapping portion of the spiral spring, the spiral spring is prevented from hooking the broken end onto the engaging member by expansion in diameter even when breakage is caused in the spiral spring.

BRIEF DESCRIPTION OF THE ACCOMPANYING DRAWINGS

FIGS. 1 through 3 illustrate the embodiment of the present invention, in which FIG. 1 shows its front elevation, FIG. 2 is a section taken along line X—X in FIG. 1, and FIG. 3 is a characteristic illustration showing relationship between a throttle valve open angle and a required torque.

DETAILED DESCRIPTION OF THE PREFERRED EMBODIMENT

The embodiment of the present invention will be discussed herebelow with reference to the drawings.

Figure 1:
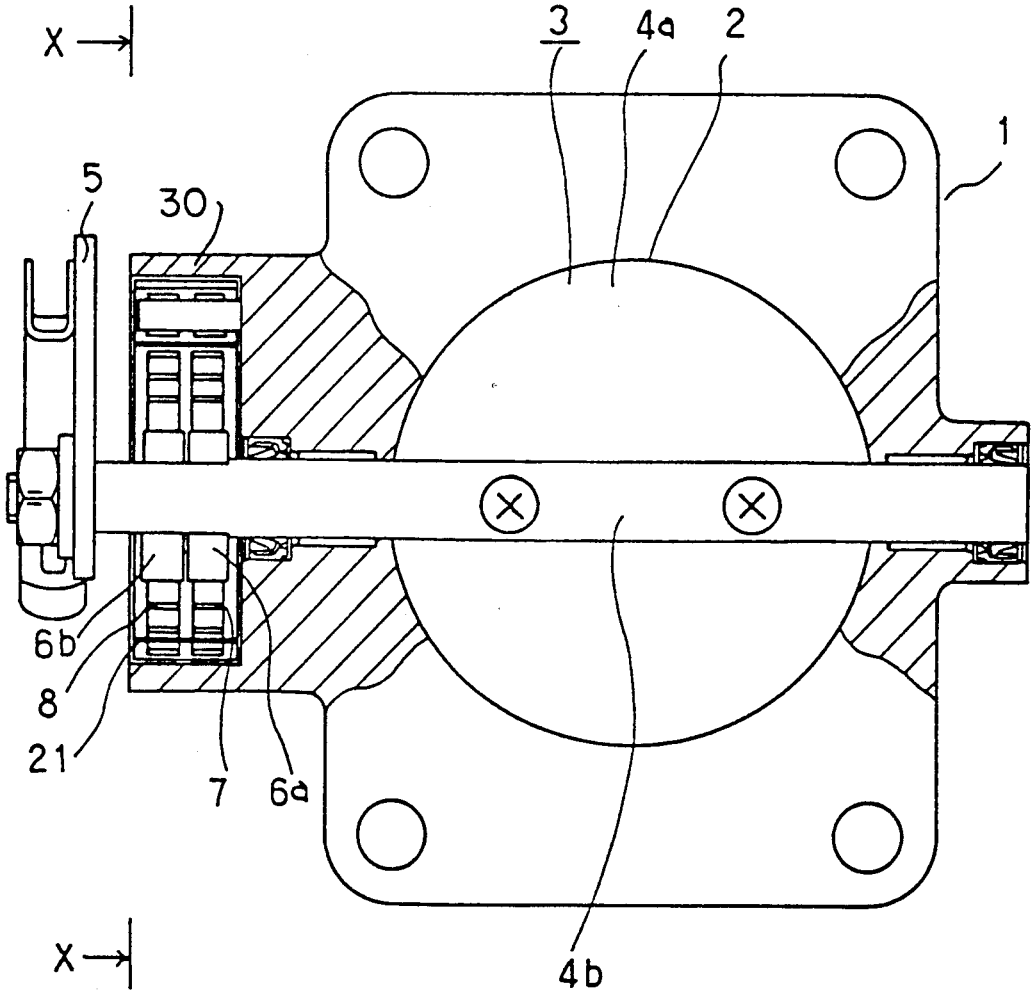
Figure 2:
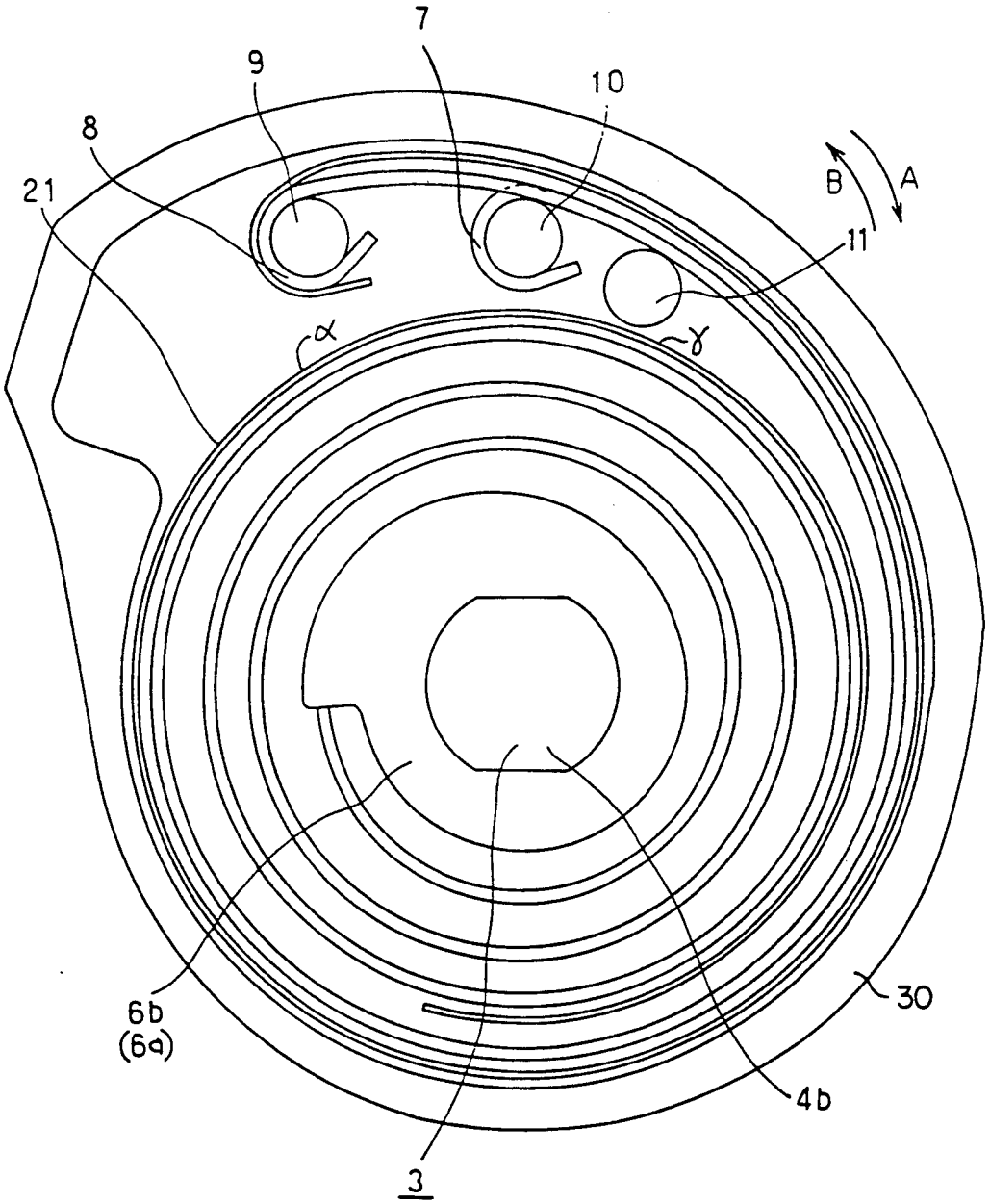

As shown in FIGS. 1 and 2 (X—X section of FIG. 1), a valve opening 2 forming an intake air flow path is formed in a throttle body 1 upon installation to an internal combustion engine. A valve body 4*a* of a throttle valve 3 is disposed within the valve opening 2. The valve body 4*a* is fixed to a rotary shaft 4*b* of the throttle valve 3 by means of screws, which rotary shaft 4*b* is rotatably supported on the throttle body 1. A throttle lever 5 is secured onto the left side end of the rotary shaft 4*b* extending from the throttle body 1. The throttle lever 5 is linked with an accelerator pedal is of the vehicle via not shown a wire. As shown in FIG. 2, according to operation through the accelerator, the rotary shaft 4*b* together with the throttle lever 5 rotates clockwise (arrow A) to open the throttle valve 3, and the rotary shaft 4*b* rotates in counterclockwise direction (arrow B) to close the throttle valve 3. According to opening and closing of the throttle valve 3, the intake air flow rate for the internal combustion engine is controlled. The range of rotation of the throttle valve 3, i.e. operational range between fully open position and fully closed position, is set approximately at 90°.

In the foregoing rotary shaft 4*b*, sword guard shaped sections 6*a* and 6*b* which are made of nylon 66 are respectively disposed between the throttle body 1 and the throttle lever 5. To the sword guard shaped sections 6*a* and 6*b*, spiral springs 7 and 8 are wound. The center side end (inner end) of respective spiral springs 7 and 8 are fixed to the jew sections 6*a* and 6*b* by way of insert molding.

The outer peripery side ends (outer ends) of the spiral springs 7 and 8 are bent in U-shaped fashion and positioned offset from each other. On the other hand, in a housing 30 which is integrally formed with the throttle body 1 and receives the spiral springs 7 and 8, an engaging pin 9 which forms a guide member, an engaging pin 10 which forms a guide member and a guide pin 11 which also forms the guide member are provided in protrusions. The outer end of the right side spiral spring 8 is engaged to the engaging pin 9. With its inner surface being in contact with the engaging guide pin 10 at the position in the vicinity of the outer end thereof. The spiral spring 7 is engaged to the engaging guide pin 10 at the outer end thereof with the inner surface thereof being in contact with the guide pin 11 at the position in the vicinity of the outer end thereof. The guide pin 11 and the engaging guide pin 10 are respectively disposed between the strings of the spiral springs 7 and 8 so that, when the spiral springs are contracted in diameter according to opening and closing motion of the throttle valve in, they may restrict contact between the strings 7 and 8.

Furthermore, on the outer peripheral section of the spiral spring 7 and 8, a guide 21 is provided with one end being press fitted around 8*a*which is bent into U-shaped configuration, and the other end formed in free end so as not to interfere motion of the spiral springs 7 and 8.

Accordingly, both spiral springs 7 and 8 bias the rotary shaft 4 in counterclockwise direction (arrow B in FIG. 2) and constantly act in a direction for closing the throttle valve 3. When the accelerator pedal is operated, the rotary shaft 4*b* rotates in the clockwise direction (arrow A in FIG. 2) against the bias forces of the spiral springs 7 and 8 to open the throttle valve 3.

Next, the operation of the shown embodiment will be discussed.

While the accelerator pedal is not operated, the throttle valve 3 is maintained at the closed position by both biasing force of spiral springs 7 and 8. When the accelerator is operated, the rotary shaft 4*b* is rotated in clockwise direction (arrow A in FIG. 2) against the biasing force of both spiral springs 7 and 8 to open the throttle valve.

At this time, the spiral springs 7 and 8 are retracted around the rotary shaft 4*b* to contract the diameter thereof. Therefore, as shown by arrow C in FIG. 2, the portions of the spiral springs 7 and 8 in the vicinity of the outer ends are inclined to move inwardly with the spiral springs 7 and 8 as the center. However, since the movement of the outer end of the spiral spring 7 is restricted by the engaging guide pin 10 and the motion of the outer end of the spiral spring 8 is restricted by the guide pin 11, contact between the strings of the spiral springs 7 and 8 is prevented.

With the construction employed herein disclosed, there are the following two merits.

(1) Reduction of Friction Torque

Figure 3:
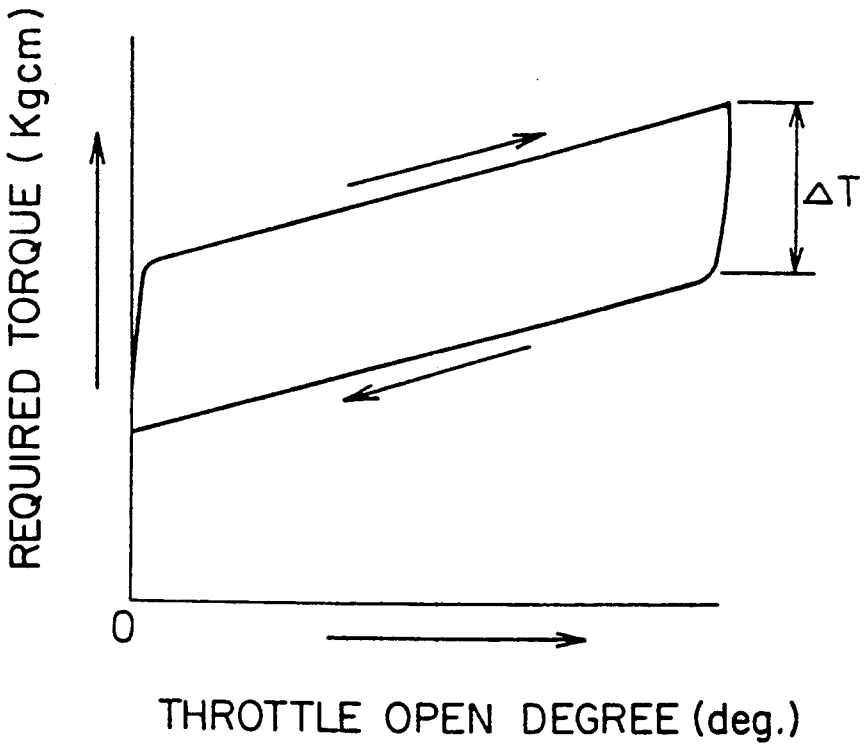

As shown in FIG. 3, when the throttle valve 2 is operated to open, greater torque is required than that for closing the throttle valve. There is a difference of ΔT. This is caused by friction on the rotation of the rotary shaft 4*b* and friction when winding spring for closing the throttle valve. In case of the general type of opening and closing devices employing the torsion coil springs, most of the above-mentioned ΔT is generated by friction during retraction of the spring for closing the throttle valve. In the opening and closing device according to the invention, since the spiral springs 7 and 8 will not be placed in sliding contact with other elements, the resistance by this can be completely avoided and therefore, ΔT is substantially small. In case of the throttle valve opening and closing device employing the torsion coil spring, 30% of the required torque for opening and closing becomes the friction ΔT. In contrast, in the shown embodiment of the throttle valve opening and closing device, it has been experimentarily confirmed that the friction becomes 10% of the required torque for opening and closing ΔT. Therefore, since the friction ΔT can be made smaller, the biasing force of the spiral spring can be made smaller so that it can avoid the lowering of vehicular acceleration characteristics due to stiffness of the accelerator.

(2) Reduction of Size of the Overall Device

As set forth above, in the shown embodiment of the throttle valve opening and closing devices, since spiral springs 7 and 8 having smaller width than the torsion coil spring are employed for biasing the throttle valve 3 in valve rotating side, required installation space necessary in axial center direction can be very small. Therefore, it becomes possible to reduce the overall size of the device.

However, on the other hand, when breakage is caused in one of the spiral springs 7 and 8, the broken spiral spring can expand in diameter and being hooked with the housing 30 or guide pin 11 at its broken end to make it impossible to cause torsion on the valve body 4*a*. The cause of hooking is the free movement of the broken end of the spiral spring.

In this embodiment, in order to prevent hooking, the guide 21 is arranged along the outer peripheries of the spiral springs 7 and 8 so that it may prevent expansion of diameter of one broken end even when breakage is caused in one of the spiral springs 7 and 8 and thus can prevent hooking onto the engaging pin 9, the guide pin 11, the engaging guide pin 10 and the inner periphery of the housing 30. The guide member 21 is formed of phosphor bronze which is soft enough not to cause wearing of the spiral springs when it contacts.

Furthermore, in order to prevent increase of friction ΔT due to contact of the guide 21 onto the spiral springs 7 and 8, one end of the guide 21 is made in a free end, and the thickness is 0.1 to 0.5 so as to move with light force and not interfere the movement of the spiral spring. In addition, in order to reduce contact resistance, teflon coating is provided for the surface.

With the construction set forth above, it has been experimentarily confirmed that the friction ΔT when the guide 21 is inserted, can be maintained substantially equal to that when the guide 21 is not inserted, and therefore the resistance can be made substantially zero.

Furthermore, even when breakage is caused on the spiral springs 7 and 8, since the broken end will move on the guide 21, it will never hook on the housing 30 and never hook on the guide pin 11, the engaging guide pin 10 or the engaging pin 9.

On the other hand, though the guide 21 extends over approximately one and half turns along the outer periphery of the spiral spring 9 from the engaging pin 9 where the outer end portion of the spiral spring 9 is arranged, in the shown embodiment, it may be possible to provide the guide 21 only for the overlapping portion of the spiral springs 9 (corresponding to a range from $\alpha$ to $\beta$ in FIG. 2) for preventing the broken end of the spiral springs 7 and 8 from hooking onto the engaging pin 9, the guide pin 11 and the engaging guide pin 10. That is, when the spiral springs 7 and 8 is broken, the broken portion expands in diameter and in a diametrically expanded state rotate within the rotational range of the throttle valve 3 according to opening and closing of the throttle valve 3. However, as shown in FIG. 2, at the overlapping portion, by providing the guide 21 in a range from $\gamma$ to $\beta$ in the drawing, which range is wider than the rotational range (90°) of the throttle valve, in the vicinity of the guide pin 11 ($\gamma$ in the drawing), the broken end rotates on the guide 21 and will never contact with the guide pin 11, the engaging guide pin 10 and the engaging pin 9.

Namely, in order to prevent the broken portion from contacting with the guide pin 11, the guide 21 has to be extended at least by the rotational range of the throttle valve 3 from the position in the vicinity of the guide pin ($\gamma$ in the drawing).

On the other hand, after setting the spiral springs 7 and 8 in the guide 21 and subsequently assembling to the housing, expansion in diameter of the spiral springs 7 and 8 can be prevented by the guide 21 to improve assembling ability.

As explained above, according to the present invention, since the guide member is arranged at least over the overlapping section of the spiral springs which bias the throttle valve in closing direction, the broken end of the spiral spring will not expand in diameter to be hooked onto the engaging pin being the engaging member or so forth, even when breakage is caused in the spiral spring, and thus biasing the throttle valve toward opening direction can be prevented.

What is claimed is:

1. A safety apparatus for an internal combustion engine comprising:

a rotary member arranged at a rotating portion of the internal combustion engine;

a spiral spring having one end supported on said rotary member and biasing said rotary member toward a predetermined direction;

an engaging member engaging with the other end of said spiral spring;

a housing for receiving said spiral spring;

a guide member arranged at least over the outer side overlapping portion of said spiral spring and extending circumferentially along the periphery of said spiral spring for preventing expansion of said spiral spring in diameter.

2. A safety apparatus for an internal combustion engine comprising:

a throttle body defining an intake air path;

a throttle valve for adjusting air flow rate through said intake air path;

a rotary shaft coupled with said throttle valve for mounting said throttle valve onto said throttle body in rotatable fashion;

a spiral spring having one end supported by said rotary shaft and biasing said throttle valve in a closing direction;

a housing for receiving said spiral spring, said housing being provided in said throttle body and having an engaging member to which to other end of said spiral spring engages;

a guide member arranged at least over the outer side overlapping portion of said spiral spring and extending circumferentially along the periphery of said spiral spring for preventing expansion of said spiral spring in diameter.

3. A safety apparatus for an internal combustion engine as set forth in claim 2, wherein said guide member is engaged to said engaging member together with the outer periphery end of said spiral spring and extends along the outer periphery of said spiral spring over a length corresponding to a range of one turn of outermost periphery of said spiral spring plus the rotational range of said throttle valve.

4. A safety apparatus for an internal combustion engine as set forth in claim 3, wherein the rotational range of said throttle valve is approximately 90°.

5. A safety apparatus for an internal combustion engine as set forth in claim 2, which further comprising a guiding member disposed between strings of said spiral spring for guiding said spiral spring for restricting contact between strings when said spiral spring reduces the diameter according to opening and closing movement of said throttle valve, and said guide member is engaged to said engaging member together with said the other end of said spiral spring and extends along the outer periphery of said spiral spring over a length corresponding to a range of one turn of outermost periphery of said spiral spring adding further the rotational range of said throttle valve from said guide member.

6. A safety apparatus for an internal combustion engine as set forth in claim 5, wherein the rotational range of said throttle is approximately 90°.

* * * * *